United States Patent [19]

Ericsson

[11] Patent Number: 4,526,101

[45] Date of Patent: Jul. 2, 1985

[54] ARRANGEMENT FOR DRYING PRINTED MATERIAL

[76] Inventor: Sylve J. D. Ericsson, Tolléns väg 8, 147 00 Tumba, Sweden

[21] Appl. No.: 541,970

[22] Filed: Oct. 14, 1983

[51] Int. Cl.[3] ..... D41F 23/00; F26B 3/28

[52] U.S. Cl. ..... 101/416 R; 101/126; 34/4

[58] Field of Search ..... 101/416 R, 416 A, 126; 34/46, 48, 53, 41, 55, 162, 151, 49, 4

[56] References Cited

U.S. PATENT DOCUMENTS

| | | | |
|---|---|---|---|
| 2,359,825 | 10/1944 | Campbell | 101/416 R X |
| 2,479,913 | 8/1949 | Doyle | 101/416 R |
| 3,008,242 | 11/1961 | Sites et al. | 101/416 A |
| 3,040,657 | 6/1962 | Ichinose | 101/416 R X |
| 3,078,587 | 2/1963 | Huck | 101/416 A |
| 3,129,442 | 4/1964 | Leckie | 101/126 X |
| 3,167,012 | 1/1965 | Claybourn | 34/162 X |
| 3,991,484 | 11/1976 | Lamb et al. | 34/162 |
| 4,033,263 | 7/1977 | Richmond | 101/416 A |
| 4,408,400 | 10/1983 | Colapinto | 34/151 X |
| 4,434,562 | 3/1984 | Bubley et al. | 34/4 |

*Primary Examiner*—Clifford D. Crowder

[57] ABSTRACT

A drying arrangement located in a drying station and intended for drying printed material includes a material-conveying path (10), preferably arranged to convey the material through the print drying station, and further including one or more drying and/or curing means (19). The print drying and/or curing means (9) is, or are, arranged to operate intermittently. A control means (12) for controlling the intermittent operation of the means (9) is arranged to activate the drying and/or curing means over a period of time in which the wet coating in the material is located adjacent the drying and/or curing means (9).

There is also included a multi-ink printing or multi-coating printing arrangement which comprises a plurality of sequentially arranged and interconnected printing machines (1, 2, 3) having intermediate drying arrangements (4 and 5). The printing arrangement has a single, intermittently operating gripping system (10) which is common to all printing machines and drying arrangements in the printing arrangement. A gripper (10*a*) in one printing machine (1) and a gripper (10*a'*) in an adjacent drying arrangement (4) form a sealing means for sealing the infeed and outfeed openings of the drying arrangement.

7 Claims, 4 Drawing Figures

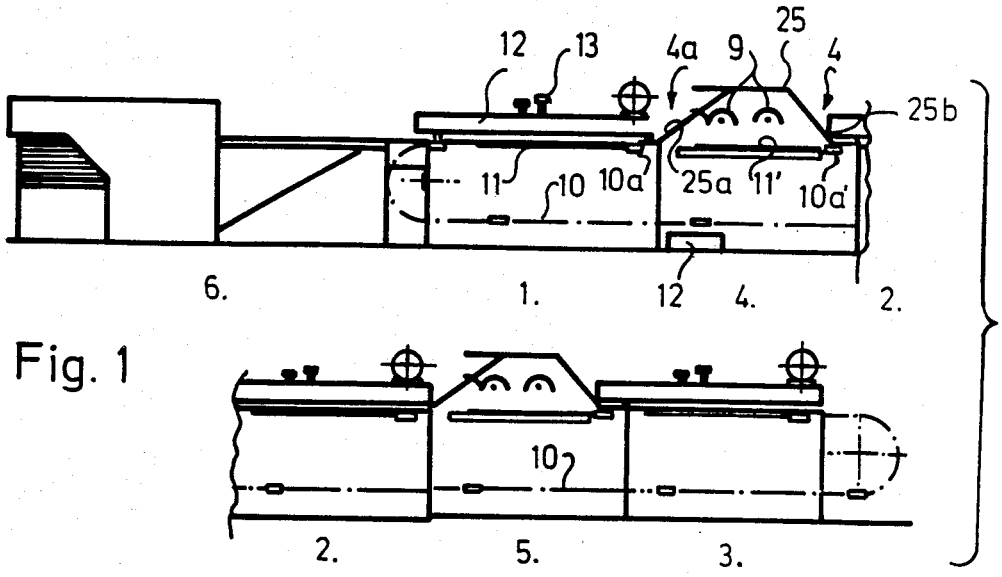
Fig. 1
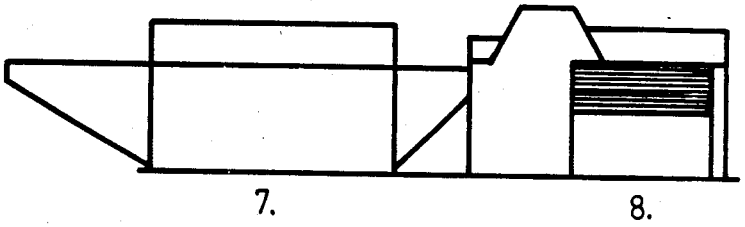
Fig. 2
Fig. 3
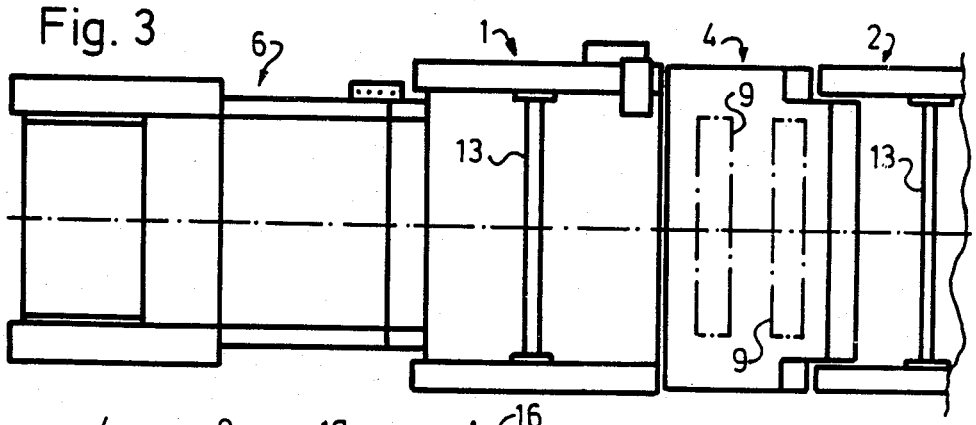
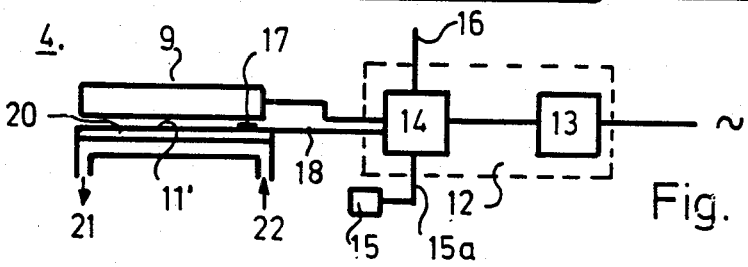
Fig. 4

ARRANGEMENT FOR DRYING PRINTED MATERIAL

TECHNICAL FIELD

The present invention relates to a drying arrangement located in a drying station and intended for drying printed material, said drying arrangement comprising material-conveying means, preferably intended for conveying the material through the drying station, and further comprising one or more print-drying and/or print curing means.

Such a drying arrangement can be used to advantage for drying material printed in a silk-screen printer, or screen process printer.

The invention also relates to a multi-colour printing or multi-coating printing arrangement utilizing a plurality of mutually coupled, sequentially arranged printing machines with intermediate drying arrangements.

BACKGROUND ART

Various drying arrangements intended for drying printing applied to a material are known to the art. By way of an example of such arrangements belonging to the prior art can be mentioned those arrangements which utilize nozzles through which a stream of warm air is directed onto the printed material, and where the stream of warm air dries the wet print and therewith also carries away the products of evaporation created when drying said print.

It is also known to dry wet print on a sheet of material with the aid of a plurality of means which generate ultraviolet radiation, so-called UV-radiation, said radiation curing the print applied to the material. Normally, the printing ink or paste used should be particularly sensitive to such radiation, in order to react to and be dried thereby.

Similarly, it is also known to dry print which has been applied to a material with the aid of means which generate infrared radiation, so-called ir-radiation, the radiation curing the print applied to the material. When applying this method, it is suitable to select a printing ink or paste which is particularly sensitive to ir-radiation and which will dry or cure under the influence thereof.

Naturally, there are known to the art other forms of drying stations and drying arrangements which are particularly designed to solve specific problems and to dry effectively wet print applied to a sheet of material.

In connection with drying stations, it is also known to take measures which enable moisture removed by evaporation during the drying process to be replaced, by permitting the material to pass through special air-humidifiers, or which ensure that the air enclosed is the drying station has the desired humidity.

It should be observed that the material can be printed in inks of mutually different colours, and the print may also have the form of an electrically conductive paste or liquid, or an electrical insulating paste or liquid. The print may even comprise a paste or liquid applied to a substrate to prevent solder adhering thereto.

In the following description the word >>coating>> has been used as a general term covering all the aforesaid possible modes of application, and also for those modes not recited above.

DESCRIPTION OF THE PRESENT INVENTION

TECHNICAL PROBLEM

One serious technical problem encountered in drying stations of previously known construction is that the energy consumed by and the power input required by said stations is normally very high, since the station is usually adapted and dimensioned to be able to dry effectively a large printed area, with thick print or a thick coating applied to a thick material.

However, since the actual printing surface can be very limited and the coating can be very thin, difficulties are experienced in readily adapting the energy and power consumption of the drying station to that required for a smaller printed area and/or a thin print coating.

Consequently, the problem of creating conditions in a drying station which enable the station to be utilized with low energy and power requirements is of a highly technical nature.

It is also a qualified problem to create such conditions that the energy consumption is adjusted to the lowest possible value conceivable in respect of a given material having a given coating size and thickness.

In addition, multi-ink printing or multi-coating printing arrangements have the disadvantage that when said arrangement comprises a plurality of mutually coupled and sequentially arranged printing machines, each adapted for its particular ink or coating, with intermediate drying arrangements, the energy consumed in each drying arrangement can be quite considerable, at the same time as the total amount of space occupied lengthwise is equal to the sum of the lengths of: a complete material infeed arrangement, a complete printing machine, a complete drying arrangement, a further complete printing machine, a further complete drying arrangement, and so on, depending upon the number of different colours to be printed on the material, and thus the number of printers needed. In addition hereto is the length of space required for a material take-up apparatus.

There is consequently a need for the provision of conditions which will enable the over-all length of space required by such a complete multi-ink printing or multi-coating printing arrangement to be reduced.

SOLUTION

The present invention primarily relates to an arrangement for drying printed material, said arrangement comprising a material-conveying path, preferably intended for conveying the material through the drying station, and further comprising one or more print-drying and/or print-curing means.

More particularly, although not exclusively, the invention relates to a solution in which the print-drying and/or print-curing means is, or are, arranged to operate intermittently, and in which a control means for controlling said intermittent operation is arranged to activate means for drying and/or curing said print during those periods of time when a wet coating on said material is located adjacent said drying and/or curing means.

According to one particular embodiment of the invention, the drying and/or curing means has, or have, the form of one or more lamps, preferably a lamp, or lamps, which generates or generate ultra-violet radiation.

The lamps may be mercury lamps controlled by control means having a choke and an igniter means.

The control means is arranged to ignite the lamps in at least one such intermittent operational sequence where the ignition time is sufficiently long to maintain the operational requirement that an ignition pulse, when the lamps are switched off, causes the lamps to be immediately switched on.

The control means can also be arranged to energize the lamps over a period of time adapted to exceed a given least amount of energy radiation per unit area of material.

It has been found particularly advantageous to arrange for the control means to be controlled by the printing sequence of a printing machine coupled immediately adjacent to and upstream of the drying arrangement.

The drying arrangement coveniently includes a table which forms a support for said material and the surface of which is provided with a plurality of holes which co-act alternately with a source of subpressure and a source of air under pressure, so that during the time taken to effect a drying and/or hardening operation, the table is connected to the source of subpressure, so as to hold the material against the table, and during the remaining time periods is connected to the source of air under pressure, so as to lift the material from said table.

With the purpose of saving energy, it is proposed in accordance with the spirit of the invention that the level of energy radiated per unit of time is selected to skin-cure the coating.

The present invention also relates to a multi-ink printing arrangement or multi-coating printing arrangement having a plurality of printing machines coupled sequentially together with a drying arrangement between mutually adjacent machines, preferably a drying arrangement of the afore-described construction.

Such a multi-ink printing or multi-coating printing arrangement has a single, intermittently operating gripper system which is common to all printing machines and drying stations in said printing arrangement.

It is also proposed that a gripper in a printing machine and a gripper in an adjacent drying station shall be designed to form a sealing means for sealing infeed and outfeed openings located in the drying arrangement.

ADVANTAGES

Those advantages which can be considered primarily associated with a drying arrangement according to the inventions are that conditions are created for greatly reducing the amount of energy and power required, since the drying arrangement can be caused to operate only during those periods of time when the wet coating on a sheet of material is located adjacent the drying and/or curing means, while the energy can be selected at such a low level that said coating is only skin-cured, this latter when subsequent treatment of the material does not require the coating to be thoroughly hardened or cured.

Another advantage afforded by the invention is that the total length of a complete plant which consists of multi-ink printing or multi-coating printing machines comprising a plurality of printing machines coupled in line, one behind the other, with a drying arrangement located between adjacent machines, is considerably shorter.

BRIEF DESCRIPTION OF THE DRAWINGS

A preferred embodiment of the invention, exhibiting the main characteristics thereof, will now be described in more detail with reference to the accompanying drawings, in which FIG. 1 is a sideview of a multi-ink printing or multi-coating printing arrangement comprising a plurality of printing machines with a drying arrangement between adjacent machines, FIG. 2 is a sideview of a connecting drying arrangement and a material laying-off means, FIG. 3 is a horizontal view of part of the arrangement illustrated in FIG. 1, and FIG. 4 illustrated schematically a control means for intermittently activating the drying and/or curing means.

DESCRIPTION OF A PREFERRED EMBODIMENT

FIG. 1 is a sideview of a multi-ink printing or multi-coating printing arrangement having a plurality of sequentially arranged printing machines 1, 2 and 3 with intermediate drying arrangements 4 and 5.

Upstream of the printing machine 1 is a material infeed 6 and, as shown in FIG. 2, behind the printing machine 3 there is located a drying arrangement 7 having coupled thereto a material laying-off means 8.

The printing machines 1, 2 and 3 may be known silk screen printers, the operational modes of which will not be described for the sake of simplicity.

The fact that the illustrated embodiment comprises three printing machines and two intermediate drying arrangements is not means to imply that the invention is restricted to just such numbers, but that the number of printing machines should be equal the number of coatings to be applied to the material.

Since the drying arrangements 4 and 5 are mutually the same, only the arrangement 4 will be described in the following.

Thus, the drying arrangement 4 is arranged to dry printed material, said material having had print applied thereto in the silk screen printer 1, and preferably includes a conveyor path for conveying the material through the drying arrangement 4, i.e. for feeding material in at one end 4*a* and for feeding material out at the other end 4*b*.

The drying arrangement 4 includes one or more means 9 for drying and/or curing the coating (ink or paste) on the material, only two such means being shown, for the sake of simplicity. As will be understood, in reality a plurality of such means are positioned to cover the whole of the printed material, but since the positioning of said means is effected by simple and suitable measures, the manner in which said means 9 are positioned will not be described in detail.

All printing machines 2 and 3 and the drying arrangements 4 and 5 are coupled together to form a unit and utilize an interconnected gripping system which comprises a plurality of grippers or gripping bars, each of which is arranged to grip and firmly hold its respective sheet of material. The gripping system is referenced 10 in the drawing. Material 11 to be supplied with print is held firmly by a gripping bar 10*a*. The print or coating is applied by a printing machine through a stencil which is incorporated in the machine and which is mounted in a frame 12, the machine also employing a squeegee and a filling means 13 in a known manner. The gripping system is stationary during a printing sequence, with the gripping bars locked or pegged.

Upon completion of the printing sequence in the printing machine, the gripping system is displaced forwardly, so that the gripping bar 10*a'* together with the material 11' gripped thereby are located immediately adjacent the coating-drying and/or coating-curing means 9. Before this displacement of the gripping system takes place, a fresh sheet of material has been taken from the co-followings grippers located immediately rearwardly of the said gripping bar 10*a'*, and placed beneath the frame 12*a*, to be supplied with a similar print. During the time taken to print this subsequent sheet of material in the printing machine 1, the means 9 are active in drying and curing the wet coating on the sheet of material 11'.

Thus, the print-drying and/or curing means 9 is, or are, arranged for intermittent operation, which operation is controlled by a control means, referenced 12 in FIG. 4, arranged to activate the drying and/or curing means 9 during the time that the wet coating of a sheet of material is located in the vicinity of said means.

In this embodiment, the drying and/or curing means 9 comprise, or comprises, one or more lamps, preferably lamps which generate ultra-violet radiation, for example mercury lamps of the kind sold by Philips, Holland under the designation HOK2.

The mercury lamps used in accordance with the invention can be controlled by the control means 12, which includes a choke and an igniter, the choke being referenced 13 in FIG. 4 and the igniter being referenced 14 in the same Figure.

When using mercury lamps sold by Philips under the designation HOK2, it has been found suitable to use a choke 13 manufactured by May G. Christe GmbH, FRG and designated >>Q1V 2000-04, 2H>>, while the igniter 14 may consist of an igniter sold by Leuen Berger, Switzerland, under designation >>Z6es>>.

With regard to the control means 12, and to the use of the mercury lamps mentioned above by way of example, it is suggested that the control means be connected with an activating or energizing circuit 15 arranged to control said control means in a manner such that the lamps are energized at least during one such intermittent operational period where the ignition time is sufficiently long to sustain the operational condition that an ignition pulse gives an immediately effective effect, are then preferably a full effect. The ignition pulse is assumed to be supplied by conductor 15*a*.

As will be understood, the operating condition for the lamp shall be fulfilled in normal operation with a sufficiently high frequency and sufficiently long energizing period for the lamp to be ignited immediately by the voltage applied across the lamp by the control circuit.

Since the lamp is allowed to cool slightly between consecutive energizing periods, there is normally required a slightly higher ignition voltage across the lamp 9 at the moment of ignition than in normal operation.

The control means may also be arranged to energize the lamps 9 over a period of time so adapted that the level of energy radiated by the lamps only slightly exceeds a lowest energy emission to the material, per unit of area. This can be effected by means of a sensor 17 arranged beneath the lamp 9 and connected to the control circuit 12 through a conductor 18.

One such value may be approximately 0.18 W/cm$^2$, which has been found sufficient to skin-cure the coating.

It is particularly convenient to arrange for the control means to be controlled primarily by the printing machine 1, so as to generate energizing pulses for igniting lamps 9 via the conductor 16. For example, it may be suitable for the printing machine to deliver a trigger pulse when the material has taken the correct printing position in the machine, so that the coating on one sheet of material is cured in the drying arrangement at the same time as another sheet of material is supplied with print.

The drying arrangement 4 is provided with a table 20 which forms a support for the material 11'. Although not shown, the surface of the table 20 has arranged there is a plurality of holes which co-act alternately with a subpressure source 21 and with a source 22 of air under pressure, such that during the time period when a coating is being dried and/or cured via the lamps 9, the table is connected to the sub-pressure source, via valves, not shown. This means that part of the heat radiated from the lamps 9 is absorbed directly by those parts of the table located outside the area covered by the material, while the heat radiated on the material 11' will also be transmitted to the table, as a result of the direct contact of the material with the surface 20 of the table. During the remaining time periods, the table is connected to the source 22 of air under pressure. As a result the material 11' will be supported on a cushion of air and can readily leave the table, when the gripping bar 10*a'* moves the material to the next printing machine 2, while the air flow cools down the heated table 20, so that said table is relatively cold when the next sheet of material to be printed upon arrives at the drying arrangement 4 from the printing machine 1.

It is particularly suitable to select the level of energy radiated from the lamps 9 per unit of time, so as solely to skin-cure the coating on the material.

The reason why the coating need only be skin-cured is because the coating is then sufficiently firm to permit a further coating to be applied without said further coating running into the former.

As will be understood, if it is desired to cure a coating completely, the intensity of the radiation from the lamps can be increased and the period over which the lamps are energized lengthened.

The invention also relates to a multi-ink printing or multi-coating printing arrangement which includes a plurality of interconnected printing machines 1, 2 and 3 arranged sequentially one behind the other. Arranged between mutually adjacent printing machines is a drying arrangement 4 and 5. The arrangement also includes a gripping system which is common to the whole of said printing arrangement and which is intended to pass through all of the printing machines 1, 2 and 3 and through the drying arrangements 4 and 5. As before mentioned, the gripping system operates intermittently, such that the material is displaced from a material laying-on means 6 to a gripper which grips the material and moves it to the printing position in the printing machine 1, whereafter the material is again displaced by the gripper system to the drying arrangement 4, and so on. When the ultimate coating has been applied to the material in the printing machine 3, the material is allowed to pass to a drying arrangement 7, in which the coatings on said material are thoroughly dried or cured, said material being passed from the drying arrangement 7 to a laying-off means 8.

It is particularly suitable for the hood 25 of the drying arrangement to be designed so that a part 25*a* intrudes against, or is registered with, the gripping bar 10*a*, and so that a part 25*b* intrudes against, or is registered with, the gripping bar 10*a'*, so that in this way a gripper of one printing machine and a gripper of an adjacent drying arrangement are able to form a sealing means for sealing the infeed and outfeed openings of the drying arrangement, thereby to prevent light and heat from passing to the printing machines 1 and 2 from the drying arrangement 4, to cause premature and troublesome curing of the printing materials.

The invention is not restricted to the aforedescribed exemplary embodiment, but can be modified within the scope of the following claims.

Although the control means has not been described in detail, it will be noted that one of normal skill in this art is able to obtain sufficient information from the present application to produce such a control means. A suitable energizing time is from 0.5 to 2.0 seconds, preferably from 0.8 to 1.2 seconds.

I claim:

1. An arrangement including at least one drying station for drying print deposited on material received from a printing machine, said drying station comprising conveyor means for conveying material along a path through the drying station, said conveyor means including a plurality of gripping bars which are spaced apart according to a predetermined path-length, said gripping bars extending transversely with respect to said path, a source of radiation for print-drying, and control means for intermittently operating said plurality of gripper bars and for intermittently energizing the source of radiation for drying said print during a period of time when wet print coating said material is adjacent said source of radiation, wherein said drying station is provided with a hood positioned about said source of radiation, said hood having an infeed opening and an outfeed opening for receiving and discharging, respectively, printed material, said infeed opening and said outfeed opening being spaced apart according to said path-length, said plurality of gripper bars being driven intermittently such that members of said plurality of gripper bars are registered with said infeed opening and said outfeed opening when said source of radiation is energized for drying said print so that said members substantially prevent the passage of light and heat through said infeed opening and said outfeed opening.

2. The arrangement according to claim 1, wherein said source of radiation comprises at least one mercury lamp which generates ultra-violet radiation, said at least one mercury lamp being controlled by a choke device and an igniter element included in said control means, said at least one mercury lamp being energized by said control means in an operational sequence wherein the igniter element provides an ignition period of sufficient duration to cause ignition of said at least one mercury lamp.

3. The arrangement according to claim 2, wherein the control means energizes said at least one lamp for a predetermined time period so that energy radiated by said at least one lamp exceeds a lowest energy emission to the material, per unit of area.

4. The arrangement according to claim 3, wherein the level of energy radiated per unit of time is selected solely for skin-curing.

5. The arrangement according to claim 1 wherein the level of energy radiated per unit time is selected solely for skin-curing.

6. The arrangement according to claim 1, wherein said arrangement is a multi-coating printing arrangement which includes a plurality of sequentially arranged printing machines which are coupled together, and intermediate drying stations between adjacent printing machines, wherein said multi-coating printing arrangement includes a single, intermittently operating gripping bar system which is common to all printing machines and drying stations in the multi-coating printing arrangement.

7. The multi-coating printing machine arrangement according to claim 6, wherein a gripper bar in one printing machine and a gripper bar in an adjacent drying station register with the infeed and outfeed openings in said adjacent drying station.

* * * * *